US011905785B2

(12) United States Patent
Rakhunde

(10) Patent No.: US 11,905,785 B2
(45) Date of Patent: Feb. 20, 2024

(54) PRESSURE CONTROL SYSTEMS AND METHODS

(71) Applicant: SCHLUMBERGER TECHNOLOGY CORPORATION, Sugar Land, TX (US)

(72) Inventor: Vikas Rakhunde, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 126 days.

(21) Appl. No.: 17/754,810

(22) PCT Filed: Oct. 15, 2020

(86) PCT No.: PCT/US2020/055692

§ 371 (c)(1),
(2) Date: Apr. 13, 2022

(87) PCT Pub. No.: WO2021/076704

PCT Pub. Date: Apr. 22, 2021

(65) Prior Publication Data

US 2023/0279734 A1 Sep. 7, 2023

Related U.S. Application Data

(60) Provisional application No. 62/915,042, filed on Oct. 15, 2019.

(51) Int. Cl.
*E21B 33/06* (2006.01)

(52) U.S. Cl.
CPC ..... *E21B 33/06* (2013.01); *E21B 2200/01* (2020.05)

(58) Field of Classification Search
CPC ..... E21B 17/18; E21B 21/00; E21B 21/001; E21B 33/06; E21B 33/064; E21B 2200/01
See application file for complete search history.

(56) References Cited

U.S. PATENT DOCUMENTS 4,285,408 A 8/1981 Franks, Jr.
4,466,487 A * 8/1984 Taylor, Jr. ..... E21B 7/128 166/348

(Continued)

OTHER PUBLICATIONS

Search Report and Written Opinion of International Patent Application No. PCT/US2020/055692 dated Jan. 29, 2021; 9 pages.

(Continued)

*Primary Examiner* — Matthew R Buck
(74) *Attorney, Agent, or Firm* — Jeffrey D. Frantz

(57) ABSTRACT

A system an annular sleeve configured to be positioned in an annular space between a first annular component and a second annular component of a drilling system. The annular sleeve includes a radially-inner annular surface and a radially-outer annular surface. The annular sleeve also includes a first annular seal element coupled to the radially-inner annular surface and configured to seal against the first annular component, a second annular seal element coupled to the radially-outer annular surface and configured to seal against the second annular component, and one or more axially-extending passageways extending from a first end to a second end of the annular sleeve. The annular sleeve is configured to direct a fluid flow through the one or more axially-extending passageways across the annular sleeve.

20 Claims, 6 Drawing Sheets

(56) References Cited

U.S. PATENT DOCUMENTS

| | | | | |
|---|---|---|---|---|
| 4,550,789 | A | 11/1985 | Crow | |
| 6,634,427 | B1 * | 10/2003 | Turner | E21B 17/18 166/88.4 |
| 7,493,949 | B2 * | 2/2009 | Baird | E21B 17/10 175/323 |
| 8,955,619 | B2 * | 2/2015 | Tilton | E21B 21/14 175/48 |
| 10,316,594 | B2 * | 6/2019 | Shearer | E21B 21/08 |
| 2001/0050185 | A1 | 12/2001 | Calder et al. | |
| 2015/0068769 | A1 | 3/2015 | Xiao et al. | |
| 2019/0234166 | A1 * | 8/2019 | Strachan | F16K 3/085 |

OTHER PUBLICATIONS

International Preliminary Report on Patentability of International Patent Application No. PCT/US2020/055692 dated Apr. 28, 2022, 6 pages.

* cited by examiner

PRESSURE CONTROL SYSTEMS AND METHODS

CROSS-REFERENCE TO RELATED APPLICATION

This application is a National Stage Entry of International Application No. PCT/US2020/055692, filed Oct. 15, 2020, which claims priority to and the benefit of U.S. Provisional Application No. 62/915,042, entitled "PRESSURE CONTROL SYSTEMS AND METHODS," filed Oct. 15, 2019, which is hereby incorporated by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below the surface of the earth, drilling and production systems are often employed to access and extract the resource. These systems may be located onshore or offshore depending on the location of the desired resource. Further, such systems may include a wide variety of components, such as various casings, fluid conduits, tools, and the like, that facilitate extraction of the resource from a well during drilling or extraction operations. In some typical systems, a drill string may extend through a wellhead assembly mounted to the well and may be used to form (e.g., drill) the well. The well may be lined with casing, which may generally stabilize the well and/or isolate fluids within the wellbore from surrounding subterranean formations. During drilling operations, drilling mud may be directed into the well through the drill string and may exit the wellbore via an annular space between the drill string and the casing.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
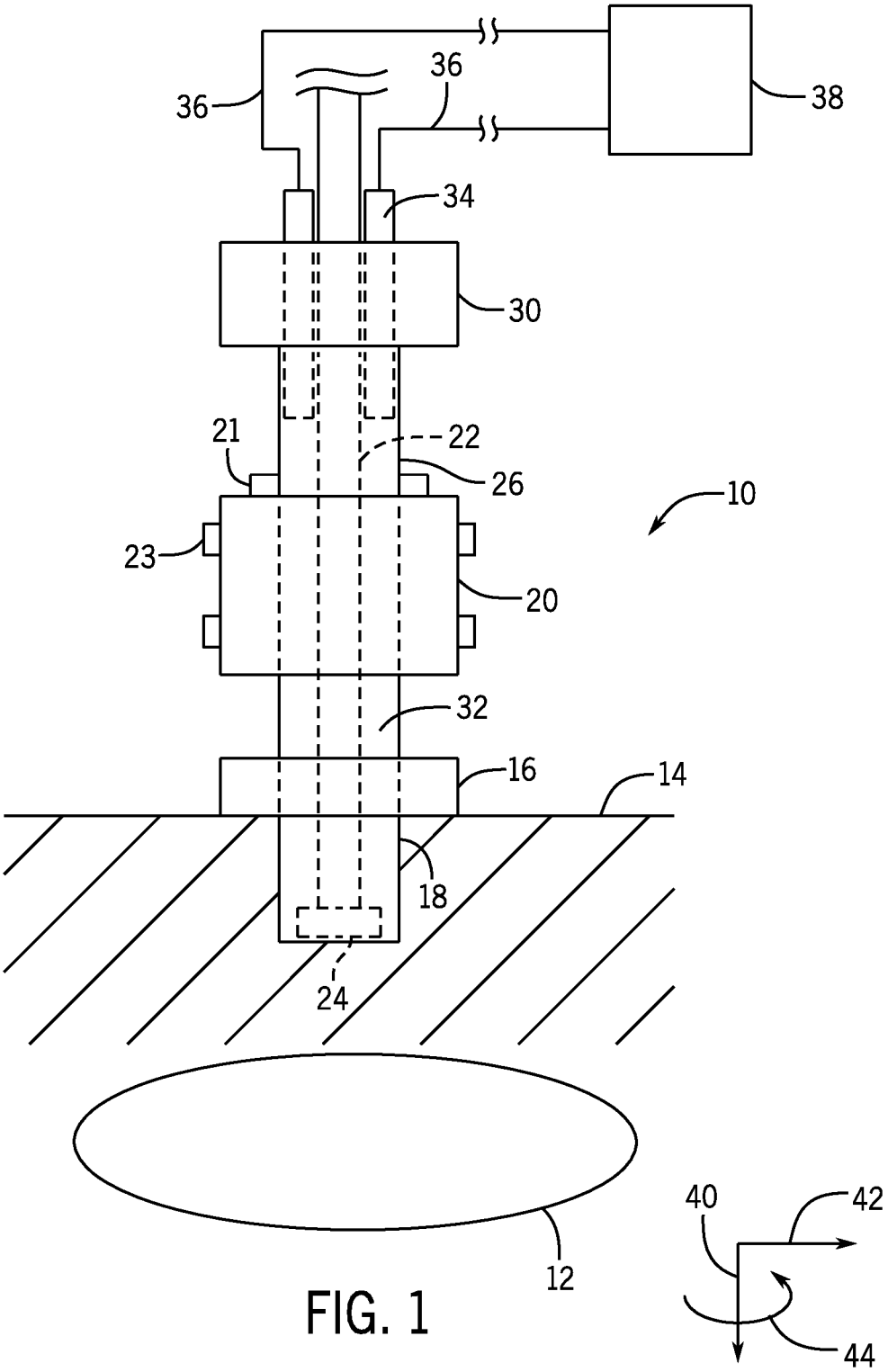
FIG. 1 is a schematic diagram of an offshore system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally directed to systems and methods that facilitate drilling operations. Certain embodiments include an annular sleeve (e.g., isolation sleeve) configured to be positioned within an annular space defined between two components of a drilling and production system, such as an annular space between a drill string and a casing. The annular sleeve may include a radially-inner wall (e.g., inner annular wall) and a radially-outer wall (e.g., outer annular wall). The radially-inner wall may be configured to seal against the drill string (e.g., via an annular seal), and the radially-outer wall may be configured to seal against the casing (e.g., via an annular seal). One or more passageways (e.g., axially-extending passageways, channels, or flow paths) extend from a first end to a second end of the annular sleeve. Thus, fluid from the wellbore may be directed into the one or more passageways and may flow through the annular sleeve via the one or more passageways. At the first end of the annular sleeve, the one or more passageways may be coupled to fluid conduits, which are in turn coupled to a fluid processing system, for example.

The annular sleeve may be utilized in any of a variety of drilling and production systems. For example, in certain embodiments, the annular sleeve may be utilized within an offshore drilling and production system that is configured to assemble the casing (e.g., to form one or more casing components or a casing material into a solid tubular structure) at a subsea location and to install the casing within the wellbore during the drilling process (e.g., as the drill string drills the well). In some such cases, the second end of the annular sleeve is positioned within an assembled portion of the casing (e.g., a solid tubular portion of the casing), and the first end of the annular sleeve extends from and is positioned above (e.g., along an axial axis) the assembled portion of the casing. Additionally or alternatively, in certain embodiments, the annular sleeve may be utilized within a drilling and production system (e.g., riser-less drilling system) that does not include a riser extending from a drilling rig at a sea surface toward the wellhead assembly to support and to circumferentially surround the drill string. The annular sleeve disclosed herein may facilitate fluid flow out of the wellbore and/or may facilitate pressure control within the wellbore during various drilling operations, such as subsea casing assembly, casing installation, and/or riser-less drilling operations, and may enable certain steps of the well completion process to be carried out simultaneously and/or reduce the time associated with completing the well, for example. In some embodiments, the annular sleeve may be utilized during maintenance operations.

While certain examples provided herein include offshore drilling and production systems that are configured to assemble casing at a subsea location, it should be understood that the annular sleeve may be adapted for use within any of a variety of offshore or onshore drilling and production systems, including drilling and production systems that use pre-formed casing sections (e.g., pre-formed into a tubular structure at the sea surface). In some such embodiments, the second end of the annular sleeve may be positioned within the casing, and the first end of the annular sleeve extends from and is positioned above (e.g., along an axial axis) the casing to facilitate fluid flow from the wellbore to a fluid processing system. Furthermore, while certain examples provided herein include riser-less drilling and production systems, it should be understood that the annular sleeve may be adapted for use within drilling and production systems that include risers. Indeed, the annular sleeve may be adapted for use within an annular space between the drill string and the riser or within any of a variety of annular spaces within drilling and production systems, such as between a wireline or any tubular and the casing, to isolate and/or to direct fluid flow during drilling operations, maintenance operations, or the like, for example.

With the foregoing in mind, FIG. 1 is an embodiment of a portion of an offshore system 10 configured to extract oil, natural gas, or other natural resources from a subsea mineral reservoir 12 below a sea floor 14. As shown, a wellhead assembly 16 may be positioned at an interface between a wellbore 18 and the sea floor 14, and a stack assembly 20 having various components, such as one or more annular blowout preventers (BOP) 21 and one or more ram BOPS 23, to control pressure during drilling operations may be positioned adjacent to the wellhead assembly 16. As shown, a drill string 22 (e.g., tubular string, production tubing string, drill pipe) extends from a location above the sea floor 14 (e.g., from a platform or drilling rig located at a sea surface) and into the wellbore 18. A tool 24 (e.g., drill bit) is positioned at one end of the drill string 22 to form (e.g., drill) the wellbore 18. In certain embodiments, the drill string 22 and the tool 24 may rotate together to facilitate formation of the wellbore 18. However, in some embodiments, the drill string 22 may not rotate, but rather, the drill string 22 may be pushed downward into the wellbore 18 as the tool 24 rotates relative to the drill string 22 to form the wellbore 18. In some embodiments, the drill string 22 may extend to the platform or drilling rig located at the sea surface, and vertical movement and/or rotation of the drill string 22 and/or the tool 24 may be controlled at the platform or drilling rig. In certain embodiments, the drill string 22 may not extend to the platform or drilling rig located at the sea surface, but rather may terminate at a subsea location. In some such cases, vertical movement and/or rotation of the drill string 22 and/or the tool 24 may be controlled at a subsea location (e.g., via a subsea electronic control system, a remotely operated vehicle [ROV], an autonomously operated vehicle [AOV], or any combination thereof). In the illustrated embodiment, the offshore system 10 is a riser-less system and does not include a riser that circumferentially surrounds the drill string 22 below the platform or drilling rig at the sea surface. Thus, fluid from the wellbore 18 does not travel to the platform or drilling rig at the sea surface via an annular space between the drill string 22 and a riser, as in certain other drilling and production systems.

As shown, a casing 26 (e.g., annular casing) is installed within the wellbore 18 to stabilize the wellbore 18 and/or to isolate the wellbore 18 from the surrounding subterranean formations. In certain embodiments, the casing 26 may be assembled (e.g., formed into a solid tubular structure from one or more casing components or material) at a subsea location. For example, the illustrated embodiment includes a casing assembly device 30 that is configured to assemble the casing 26 on-site at the sea floor 14. Accordingly, the casing assembly device 30 also may be referred to as an on-site or subsea casing assembly device 30. The casing assembly device 30 may be configured to assemble the casing 26 via any suitable technique on-site at the sea floor 14. For example, the casing assembly device 30 may include a support structure, a power source (e.g., electrical power source, fuel, etc.), a heat source (e.g., laser), a drive system, a control system (e.g., electronic controller), a monitoring system (e.g., monitor with one or more sensors), and/or other elements. In some embodiments, the casing assembly device 30 may be configured to shape, weld, and/or fuse one or more annular or non-annular casing components or materials into a solid tubular structure (e.g., the casing 26) that is configured to be inserted into the wellbore 18 to stabilize the wellbore 18 and/or to isolate the wellbore 18 from surrounding subterranean formations. In some embodiments, the casing assembly device 30, or another device within the offshore system 10, may drive (e.g., using the drive system) the casing 26 into the wellbore 18 as the casing 26 is assembled and/or as the wellbore 18 is drilled. Thus, in some embodiments, the casing 26 may increase in length (e.g., via assembly of additional casing 26 at the casing assembly device 30) and the assembled casing 26 may be driven into the wellbore 18 as the wellbore 18 is drilled to enable the casing 26 to line the wellbore 18. In certain embodiments, the assembled casing 26 may be a continuous tubular structure extending between the wellbore 18 (e.g., a bottom of the wellbore 18) and the casing assembly device 30.

During drilling operations, drilling mud is pumped through the drill string 22 into the wellbore 18 to drive cuttings out of the wellbore 18. The drilling mud, cuttings, and/or other material may exit the wellbore 18 via an annular space 32 (e.g., annulus) between the drill string 22 and the casing 26. In the illustrated embodiment, an annular sleeve 34 (e.g., isolation sleeve) is positioned within the annular space 32. In some embodiments, the annular sleeve 34 may be coupled to and supported by the support structure of the casing assembly device 30 and/or the annular sleeve 34 may extend axially through the casing assembly device 30 such that one end of the annular sleeve is positioned axially below the casing assembly device 30 and one end of the annular sleeve 34 is positioned axially above the casing assembly device 30. As discussed in more detail below, the annular sleeve 34 may seal against the drill string 22 and the casing 26, and one or more passageways (e.g., axially-extending passageways, channels, or flow paths) extend through the annular sleeve 34 to facilitate fluid flow from the wellbore 18 into fluid conduits 36, which may in turn extend to a fluid processing system 38 (e.g., shale shaker, chemical treatment system, filter, mud pit, pump, conveyor, etc.) positioned at a subsea location (e.g., coupled to a subsea platform supported by the sea floor 14) or a surface location (e.g., on a platform or drilling rig at a sea surface). The annular sleeve 34 may isolate the fluid flow from the casing assembly device 30, thereby protecting and/or sealing the casing assembly device 30 from the fluid. In certain embodiments, the annular sleeve 34 may enable the fluid to flow to the fluid processing system 38 and/or block escape of the fluid into the casing assembly device 30 and/or the environment.

When the wellbore 18 reaches the subsea mineral reservoir 12, oil, natural gas, or other natural resources may flow from the subsea mineral reservoir 12 through the annular space 32. In some embodiments, the annular sleeve 34 may be configured to remain in place after the wellbore 18 reaches the subsea mineral reservoir 12, after the casing 26 is fully assembled and installed, and/or during extraction operations, and the annular sleeve 34 may facilitate flow of the natural resources toward a suitable fluid processing system, such as the fluid processing system 38, and/or may facilitate pressure control within the wellbore 18. In some embodiments, the annular sleeve 34 is configured to be removed from the annular space 32 after the wellbore 18 reaches the subsea mineral reservoir 12, after the casing 26 is fully assembled and installed, during extraction operations, and/or after completion of maintenance operations, for example.

To facilitate discussion, the offshore system 10 and the components therein may be described with reference to an axial axis or direction 40, a radial axis or direction 42, and a circumferential axis or direction 44. In certain embodiments, the offshore system 10 is configured for managed pressure drilling operations in which the offshore system 10 includes components to regulate the wellbore pressure by controlling the flow of mud through the drill string 22 and the return of fluid through the annular space 32 and the annular sleeve 34. As noted above, it should be understood that the disclosed annular sleeve 34 may be incorporated within any of a variety of offshore or onshore drilling and production systems. For example, the annular sleeve 34 may be utilized in drilling and production systems that are configured for conventional drilling operations that maintain hydrostatic pressure within the wellbore 18. Furthermore, the annular sleeve 34 may be adapted for use within drilling and production systems that utilize pre-formed casing sections, within drilling and production systems that utilize risers, and/or within other annular spaces in drilling and production systems, such as between a wireline or any tubular and the casing, to isolate and/or to direct fluid flow during drilling operations, maintenance operations, or the like, for example.

Figure 2:
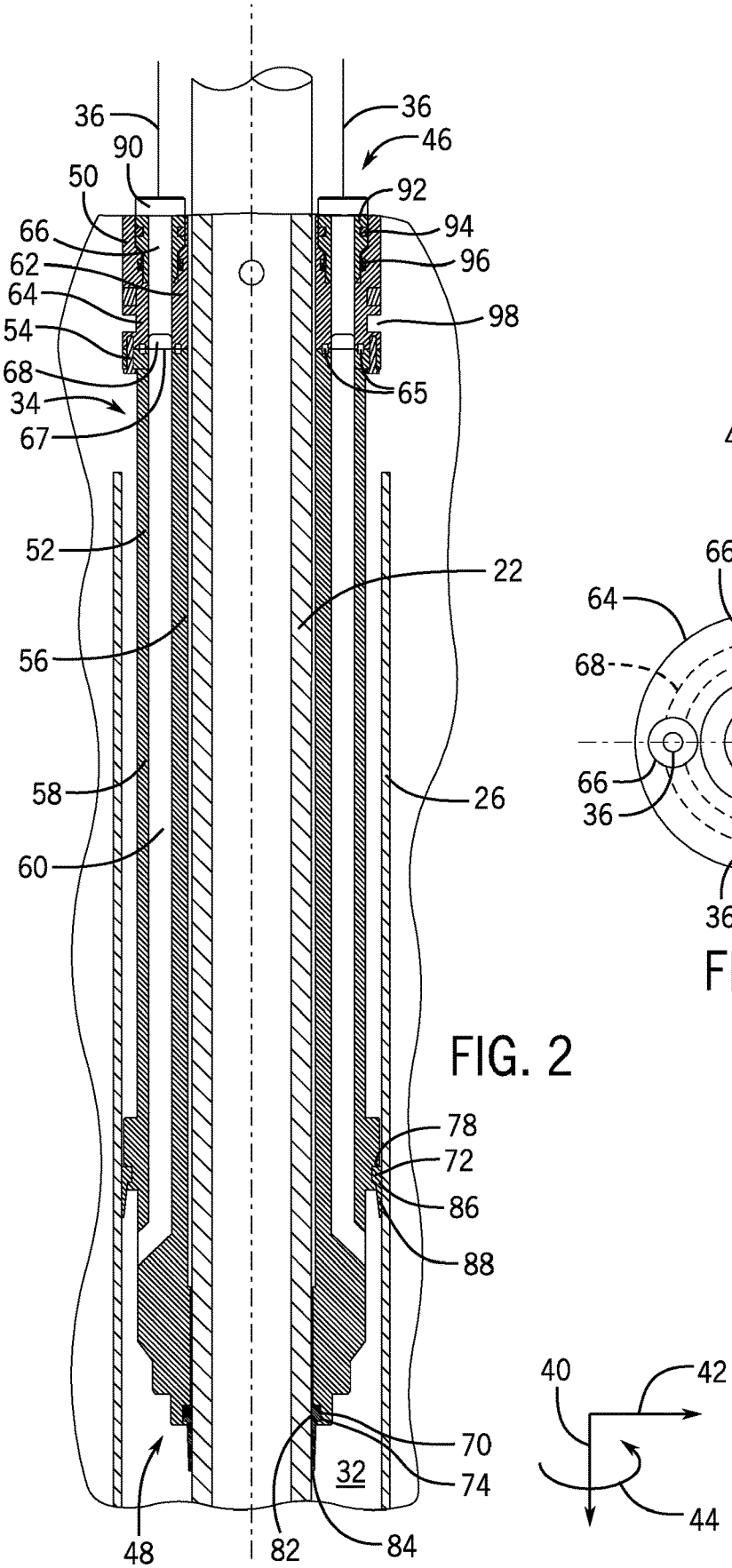
FIG. 2 is a cross-sectional side view of an annular sleeve that may be used in the offshore system of FIG. 1, in accordance with an embodiment of the present disclosure.

FIG. 2 is a cross-sectional side view of an embodiment of the annular sleeve 34. As shown, the annular sleeve 34 extends between a first end 46 (e.g., proximal end) and a second end 48 (e.g., distal end), and includes a flange 50 (e.g., annular flange or proximal portion) coupled to a body 52 (e.g., annular body or distal portion) via fasteners 54 (e.g., threaded fasteners, such as bolts). During drilling operations, at least the second end 48 of the annular sleeve 34 is positioned within the casing 26 (e.g., the assembled portion of the casing 26 having a solid tubular structure). The body 52 of the annular sleeve 34 includes a radially-inner wall 56 (e.g., inner annular wall) and a radially-outer wall 58 (e.g., outer annular wall). As shown, passageways 60 (e.g., axially-extending passageways, channels, or flow paths) extend through the body 52 of the annular sleeve 34 and are in fluid communication with the annular space 32 and the wellbore 18.

Figure 3:
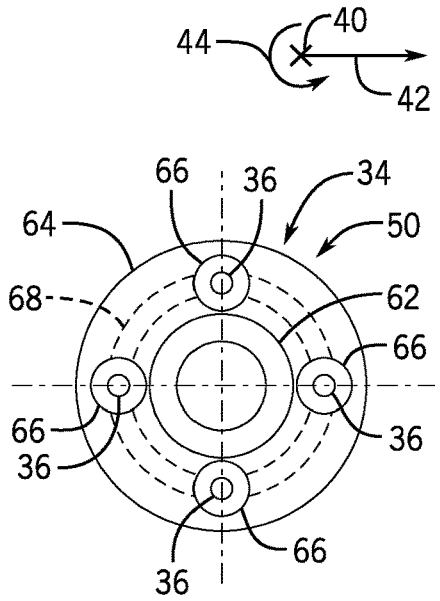
FIG. 3 is a top view of a flange of the annular sleeve of FIG. 2.

In the illustrated embodiment, the flange 50 also includes a radially-inner wall 62 (e.g., annular wall) and a radially-outer wall 64 (e.g., annular wall). As shown, passageways 66 (e.g., axially-extending passageways, channels, or flow paths) extend through the flange 50 of the annular sleeve 34 and are in fluid communication with the passageways 60 of the body 52 of the annular sleeve 34. The passageways 60 and the passageways 68 may be circumferentially spaced about the annular sleeve 34. In certain embodiments, the number of passageways 60 may be equivalent to the number of passageways 66, and each passageway 60 may align with a respective one of the passageways 66 to enable fluid flow through the annular sleeve 34. In some embodiments, the annular sleeve 34 may include a first number of passageways 60 and a second number of passageways 66, and the first number may be different (e.g., greater than or less than) the second number. In some such cases, one or more connecting passageways 68 (e.g., radially-extending and/or circumferentially-extending passageways) may be formed in at least one of the flange 50 or the body 52 to couple some or all of the passageways 60 in the body 52 to some or all of the passageways 66 in the flange 50. For example, in the embodiment shown in FIGS. 2 and 3, two passageways 60 are formed in the body 52, four passageways 66 are formed in the flange 50, and four connecting passageways 68 are formed in a bottom surface 67 (e.g., axially-facing surface) of the flange 50. The connecting passageways 68 extend circumferentially about the flange 50 and form a generally annular fluid flow path that fluidly couples the two passageways 60 within the body 52 to the four passageways 66 within the flange 50. As shown, one or more seals 65 (e.g., annular seals or gaskets) may be provided between the flange 50 and the body 52 to block fluid from escaping from the passageways 60, 66, 68 of the annular sleeve 34 at the interface between the flange 50 and the body 52. FIG. 3 illustrates a top view of an embodiment of the flange 50 of the annular sleeve 34 having the passageways 66 formed in the flange 50 and the passageways 68 extending circumferentially about the flange 50 between the passageways 66.

The illustrated embodiment includes two passageways 60 positioned at diametrically opposed locations of the body 52 of the annular sleeve 34 and four passageways 66 evenly spaced about the flange 50 of the annular sleeve. However, it should be understood that any suitable number (e.g., 1, 2, 3, 4, 5, 6, 7, 8, or more) passageways 60 may be provided at discrete locations about the circumference of the body 52 of the annular sleeve 34, and any suitable number (e.g., 1, 2, 3, 4, 5, 6, 7, 8, or more) passageways 66 may be provided at discrete locations about the circumference of the flange 50 of the annular sleeve 34. Furthermore, the passageways 60, 66 may have any suitable cross-sectional shape (e.g., circular) and/or may extend in the circumferential direction 44 about some or all of the body 52 or the flange 50, respectively, of the annular sleeve 34. For example, in some embodiments, one or both of the passageways 60, 68 may be an annular passageway.

In the illustrated embodiment, the radially-inner wall 56 of the body 52 of the annular sleeve 34 is configured to seal against the drill string 22 via an inner seal 70 (e.g., annular seal or drill string seal), and the radially-outer wall 58 of the body 52 of the annular sleeve 34 is configured to seal against the casing 26 via an outer seal 72 (e.g., annular seal or casing seal). As shown, the inner seal 70 is supported within a cavity 74 (e.g., annular cavity) formed in the radially-inner wall 56 of the body 52 of the annular sleeve 34, and the outer seal 72 is supported within a cavity 78 (e.g., annular cavity) formed in the radially-outer wall 58 of the body 52 of the annular sleeve 34. Thus, fluid from the annular space 32 is blocked from flowing between the radially-inner wall 56 and the drill string 22 and between the radially-outer wall 58 and the casing 26, and the fluid from the annular space 32 is directed into the passageways 60 of the body 52 of the annular sleeve 34.

In some embodiments, the drill string 22 and/or the casing 26 may move relative to the annular sleeve 34 without breaking the fluid seal provided by the inner seal 70 and/or the outer seal 72, respectively. For example, the inner seal 70 may be configured to maintain the seal between the drill string 22 and the annular sleeve 34 while the drill string 22 moves in the axial direction 40, and/or the outer seal 72 may be configured to maintain the seal between the casing 26 and the annular sleeve 34 while the casing 26 moves in the axial direction 40, such as during drilling operations and/or during casing assembly. As shown, the inner seal 70 includes a first portion 82 that is supported within the cavity 74 and a second portion 84 (e.g., axially-extending portion) that extends from the first portion 82 and along the drill string 22. Similarly, in the illustrated embodiment, the outer seal 72 includes a first portion 86 that is supported within the cavity 78 and a second portion 88 (e.g., axially-extending portion) that extends from the first portion 86 and along the casing 26. In some embodiments, the inner seal 70 may be undersized (e.g., an inner diameter of the inner seal 70 may be 1, 2, 3, 4, 5, 10, 15, 20, 25, or more percent less than an outer diameter of the drill string 22 prior to placement of the drill string 22 through the inner seal 70). Similarly, in some embodiments, the outer seal 72 may be oversized (e.g., an outer diameter of the outer seal 72 may be 1, 2, 3, 4, 5, 10, 15, 20, 25, or more percent greater than an inner diameter of the casing 26 prior to placement of the outer seal 72 within the casing 26). The inner seal 70 and the outer seal 72 may be formed from any suitable materials, such as elastomer, rubber, metal, or any combination thereof.

At the first end 46 of the annular sleeve 34, the passageways 66 may be fluidly coupled to the fluid conduits 36, such as via respective stabs 90 (e.g., annular fluid-conveying stabs or axial stab connectors). In the illustrated embodiment, each stab 90 is supported within a respective housing 92 (e.g., annular housing or locking dog) that includes a locking groove 94 that enables the housing 92 to couple (e.g., lock) to the annular sleeve 34. In some embodiments, one or more seals 96 (e.g., annular seals) may be provided between each housing 92 and the flange 50 of the annular sleeve 34. In certain embodiments, the flange 50 may include one or more latching grooves 98 (e.g., circumferentially-extending grooves or annular grooves) in the radially-outer wall 64 to enable the annular sleeve 34 to be coupled to (e.g., engaged by) a support structure, such as the support structure of a casing assembly device, a stack assembly, a frame or a platform supported or positioned on the sea floor 14, for example. Thus, the one or more latching grooves 98 may restrict movement of the annular sleeve 34 (e.g., vertical movement), such as in response to changes in wellbore pressure and/or friction due to movement of the drill string 22 and/or the casing 26, and/or may maintain the annular sleeve 34 in a generally fixed positioned relative to the sea floor 14 and the wellbore 18, for example.

The embodiment of the annular sleeve 34 shown in FIGS. 2 and 3 is provided as an example is not intended to be limiting. It should be understood that the annular sleeve 34 may include various other configurations or features. For example, in some embodiments, one or more of the stabs 90 and the fluid conduits 36 may extend radially from the annular sleeve 34. In some embodiments, the flange 50 and the body 52 may be fused (e.g., welded) together, and in some embodiments, the annular sleeve 34 is a one-piece structure extending from the first end 46 to the second end 48 (e.g., the flange 50 and the body 52 are integrally formed with one another).

Figure 4:
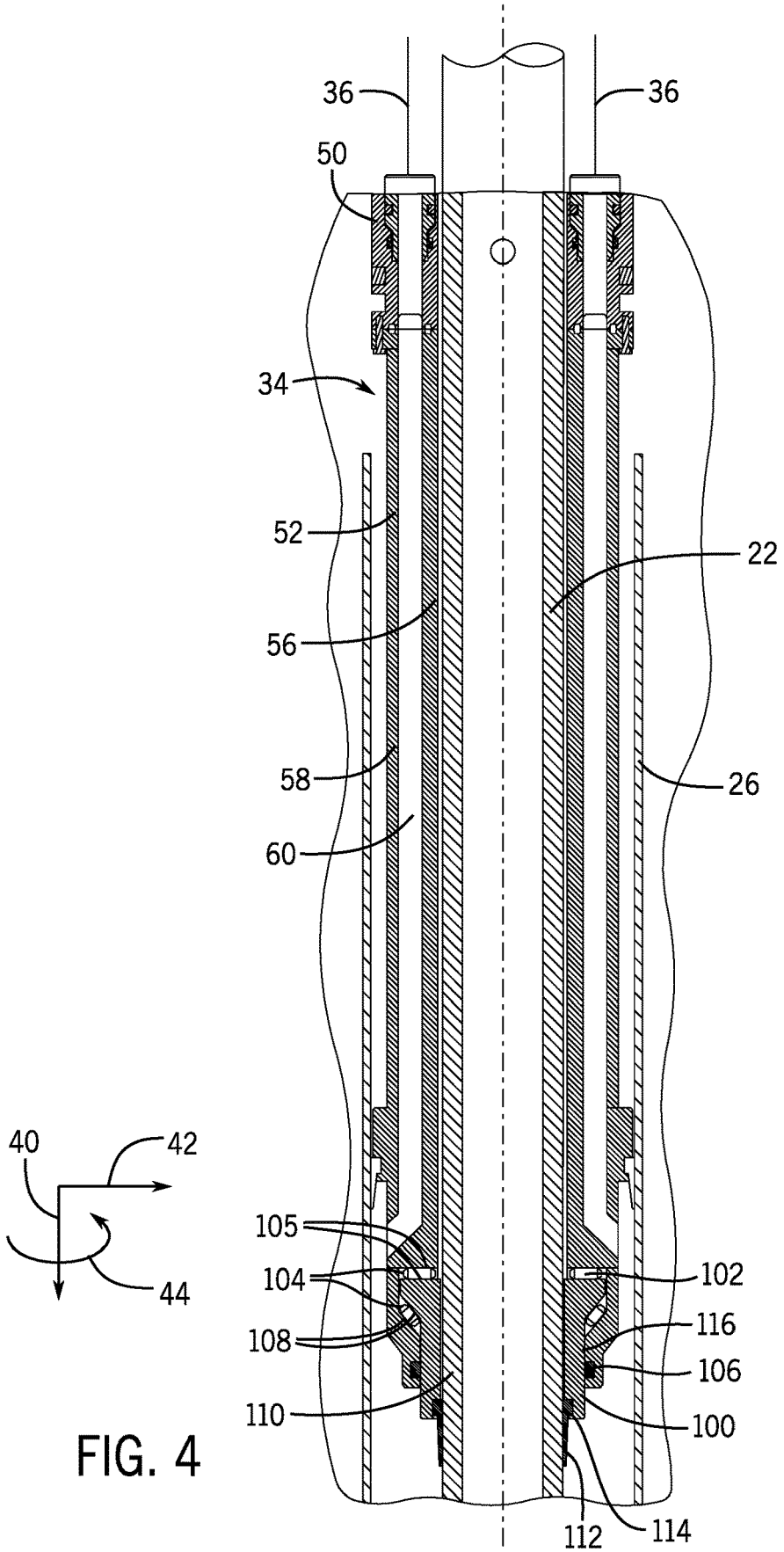
FIG. 4 is a cross-sectional side view of an annular sleeve having a rotating seal carrier that may be used in the offshore system of FIG. 1, in accordance with an embodiment of the present disclosure.

FIG. 4 is a cross-sectional side view of another embodiment of the annular sleeve 34 having a rotating seal carrier 100 (e.g., annular seal-supporting structure). As noted above with respect to FIG. 1, in some systems 10, the drill string 22 may rotate with the tool 24 to form the wellbore 18, for example. In certain embodiments, the rotating seal carrier 100 may enable rotation of the drill string 22 relative to the body 52 of the annular sleeve 34 without breaking the fluid seal provided by the inner seal 70.

As shown, a cavity 102 (e.g., annular cavity) is formed in the radially-inner wall 56 of the body 52 of the annular sleeve 34 to support the rotating seal carrier 100. The rotating seal carrier 100 may rotate within the cavity 102 relative to the body 52 of the annular sleeve 34. For example, in the illustrated embodiment, one or more bearings 104 (e.g., roller bearings) are provided in the cavity 102 between the body 52 of the annular sleeve 34 and the rotating seal carrier 100 to enable the rotating seal carrier 100 to rotate relative to the body 52 of the annular sleeve 34. In particular, as shown, the multiple bearings 104 are provided in the cavity 102 between opposed axially-facing surfaces 105 (e.g., annular surfaces) of the body 52 of the annular sleeve 34 and the rotating seal carrier 100, and between opposed tapered surfaces 108 (e.g., annular surfaces) of the body 52 of the annular sleeve 34 and the rotating seal carrier 100. The opposed tapered surfaces 108 may be tapered in opposite directions along the axial axis 40 to facilitate retention of the rotating seal carrier 100 within the cavity 102 and to restrict (e.g., block or limit) movement of the rotating seal carrier 100 in the axial direction 40 relative to the body 52 of the annular sleeve 34 (e.g., in response to changes in wellbore pressure and/or during movement of the drill string 22).

In the illustrated embodiment, a radially-inner wall 110 (e.g., annular wall) of the rotating seal carrier 100 is configured to seal against the drill string 22 via an inner seal 112 (e.g., annular seal or drill string seal), which is supported within a cavity 114 (e.g., annular cavity) formed in the radially-inner wall 110 of the rotating seal carrier 100. Thus, fluid from the annular space 32 is blocked from flowing between the radially-inner wall 110 of the rotating seal carrier 100 and the drill string 22. As shown, a carrier seal 106 (e.g., annular seal) is provided between the radially-inner wall 56 of the body 52 and a radially-outer wall 116 (e.g., annular wall) of the rotating seal carrier 100. The inner seal 112 and/or the carrier seal 106 may have any of the characteristics of the inner seal 70 described above with respect to FIGS. 2 and 3.

Figure 5:
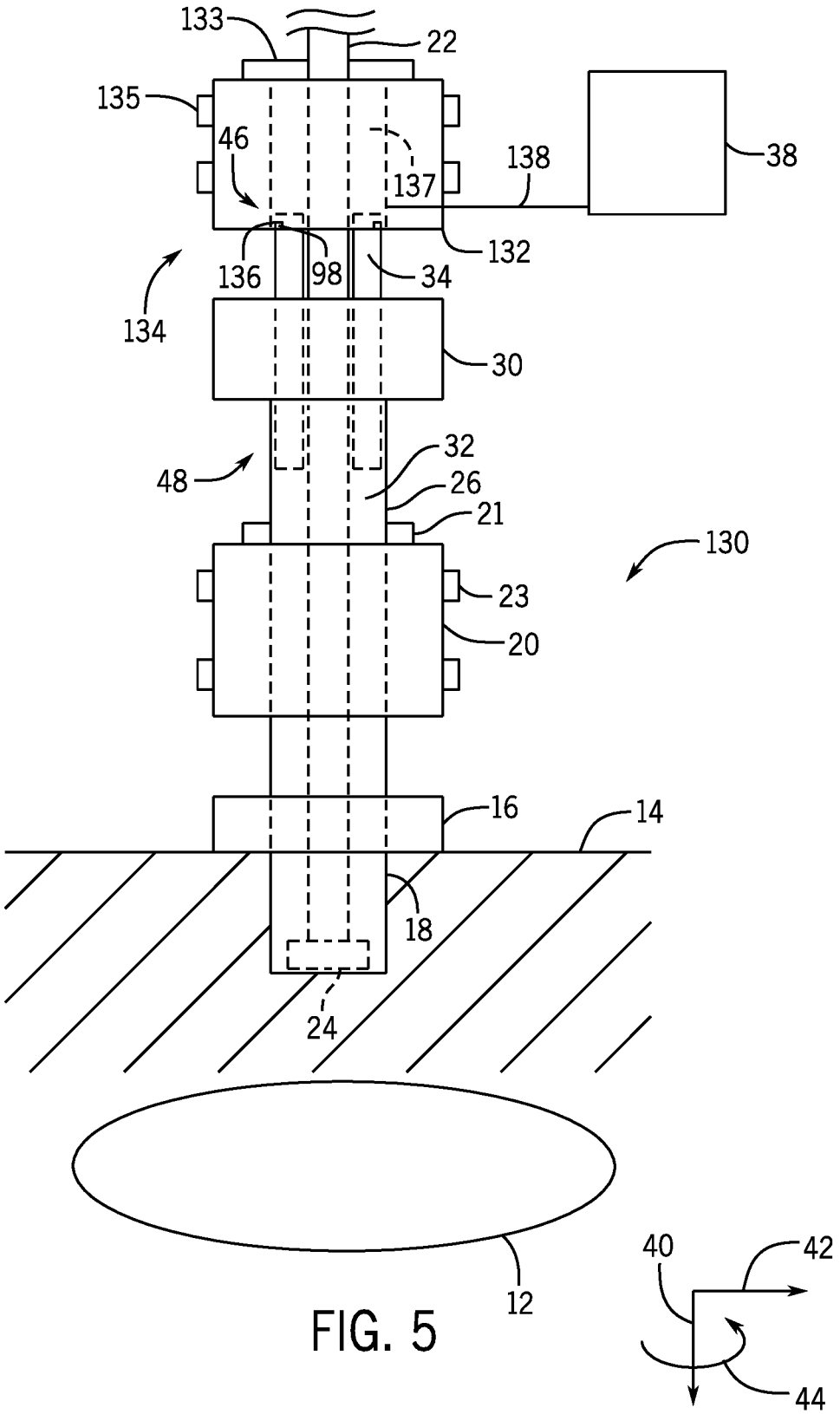
FIG. 5 is schematic diagram of another offshore system in which an annular sleeve is coupled to a stack assembly, in accordance with an embodiment of the present disclosure.

FIG. 5 is schematic diagram of a portion of another offshore system 130 in which the annular sleeve 34 is coupled to a stack assembly 132 (e.g., BOP stack assembly, subsea isolation device, etc.), in accordance with an embodiment of the present disclosure. The stack assembly 132 may include at least one annular BOP 133 positioned axially above one or more ram BOPs 135 that are configured to selectively seal and/or block fluid flow through an annular space 137 within the stack assembly 132. In the illustrated offshore system 130, the wellhead assembly 16 is positioned at the interface between the wellbore 18 and the sea floor 14, and the stack assembly 20 is positioned adjacent to the wellhead assembly 16. The drill string 22 extends from a location above the sea floor 14 into the wellbore 18. The tool 24 is positioned at one end of the drill string 22 to form the wellbore 18. In some embodiments, the offshore system 130 may be a riser-less system that does not include a riser that circumferentially surrounds the drill string 22 below the platform or drilling rig at the sea surface. As shown, the casing 26 is installed within the wellbore 18, and the annular sleeve 34 is positioned within the annular space 32 between the drill string 22 and the casing 26.

In the illustrated embodiment, the annular sleeve 34 is mechanically supported (e.g., suspended) by and coupled to the stack assembly 132. In some embodiments, the annular sleeve 34 may be coupled to a frame of the stack assembly 132 via a key-slot interface 134. For example, in some embodiments, a key 136 (e.g., protrusion or latch) of the frame of the stack assembly 132 may engage the latching groove 98 (e.g., slot) of the annular sleeve 34 to support the annular sleeve 34 and to restrict movement (e.g., in the axial direction 40) of the annular sleeve 34 relative to the stack assembly 132. The passageways 60, 66 of the annular sleeve 34 may be fluidly coupled to the annular space 137 and/or to one or more fluid conduits 138 within the stack assembly 132, such as a choke and kill line and/or a primary line, which are in turn coupled to a suitable fluid processing device, such as the fluid processing system 38, positioned at a subsea location or on a platform or drilling rig at the sea surface. Thus, in the illustrated offshore system 130, at least when the annular BOP 133 and/or the ram BOPs 135 seal the annular space 137 of the stack assembly 132, fluid from the wellbore 18 may flow through the annular space 32, through the annular sleeve 34, and into the fluid conduits 138 extending from the stack assembly 132. The illustrated offshore system 130 may facilitate fluid flow out of the wellbore 18 and/or may facilitate pressure control within the wellbore 18 during various drilling and/or maintenance operations.

In the illustrated embodiment, the offshore system 130 includes the casing assembly device 30 to assemble the casing 26 on-site at the subsea location, and the stack assembly 132 is positioned axially above (e.g., relative to the wellbore 18) the casing assembly device 30. As shown, the second end 48 of the annular sleeve 34 is positioned within the assembled portion of the casing 26 axially below the casing assembly device 30 and the first end 46 of the annular sleeve 34 is coupled to the stack assembly 132. As noted above, it should be understood that the disclosed annular sleeve 34 may be incorporated within any of a variety of offshore or onshore drilling and production systems. Thus, the offshore system 130 having the annular sleeve 34 may be configured for managed pressure drilling or conventional drilling operations that maintain hydrostatic pressure within the wellbore 18. Furthermore, the offshore system 130 having the annular sleeve 34 may be configured to utilize pre-formed casing sections and/or risers, and/or the annular sleeve 34 may be utilized within other annular spaces of the offshore system 130 to isolate and/or to direct fluid flow during drilling operations, maintenance operations, or the like, for example.

Figure 6:
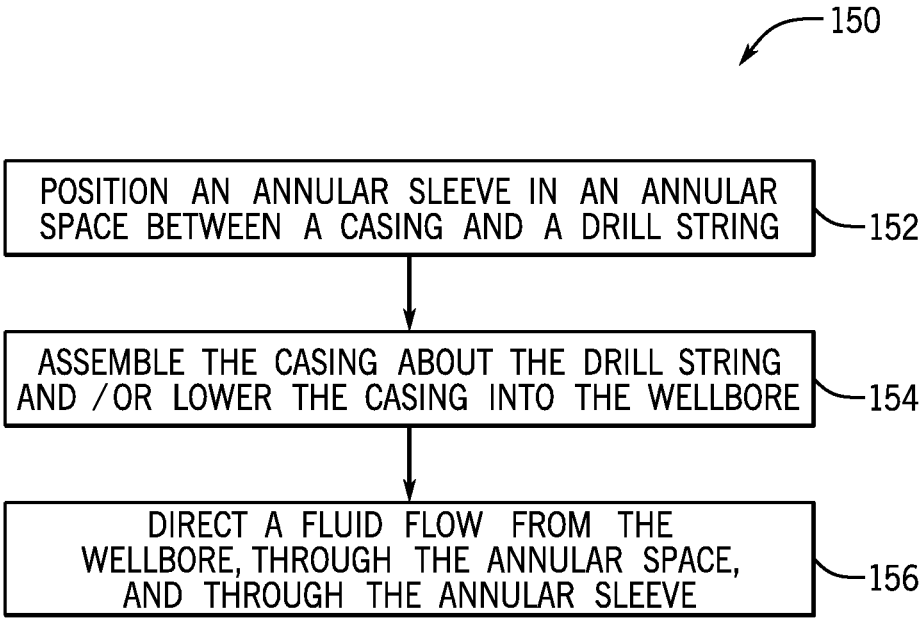
FIG. 6 is a flow diagram of a method of operating a drilling and production system having an annular sleeve, in accordance with an embodiment of the present disclosure.

FIG. 6 is a flow diagram of a method 150 of using the annular sleeve 34 within a drilling and production system, such as the offshore systems 10, 130. The method 150 includes various steps represented by blocks. To facilitate discussion, the steps of the method 150 are described with reference to the annular space 32 between the drill string 22 and the casing 26; however, it should be understood that the steps of the method 150 may be adapted to various annular spaces within a wide variety of drilling and productions systems. Although the flow diagram illustrates the steps in a certain sequence, it should be understood that the steps may be performed in any suitable order, certain steps may be carried out simultaneously, and/or certain steps may be omitted, where appropriate. Certain steps of the method 150 may be performed an operator via an electronic control system (e.g., having a processor and a memory device) and/or by an ROV or AOV. Additionally or alternatively, certain steps of the method 150 may be performed as an automated procedures (e.g., by an electronic controller).

In some embodiments, the method 150 may include positioning the annular sleeve 34 in the annular space 32 between the drill string 22 and the casing 26, in step 152. The radially-inner wall 56 of the annular sleeve 34 may seal against the drill string 22 and the radially-outer wall 58 of the annular sleeve 34 may seal against the casing 26 when the annular sleeve 34 is positioned within the annular space 32. The annular sleeve 34 may extend axially across the casing assembly device 30 and/or may be coupled to the casing assembly device 30 or to the stack assembly 132 of the offshore system 10, 130 when the annular sleeve 34 is positioned within the annular space 32. It should be understood that the annular sleeve 34 may be positioned within the annular space 32 via any of a variety of processes. For example, in some embodiments, the annular sleeve 34 may be positioned at a subsea location about the drill string 22, and the casing 26 may be subsequently formed about the annular sleeve 34 and the drill string 22 to define the annular space 32 within which the annular sleeve 34 is positioned. Furthermore, in some embodiments, the annular sleeve 34 may be positioned at a subsea location, and the drill string 22 may be subsequently inserted through the annular sleeve 34 and the casing 26 may be subsequently formed about the annular sleeve 34 and the drill string 22 to define the annular space 32 within which the annular sleeve 34 is positioned.

The method 150 may include assembling the casing 26 about the drill string 22 and/or lowering the casing 26 into the wellbore 18, in step 154. In some embodiments, the casing 26 may be assembled and/or lowered as the tool 24 coupled to the drill string 22 drills the wellbore 18. In some embodiments, the casing 26 may be assembled on-site at the sea floor 14 using the casing assembly device 30.

The method 150 may include directing a fluid flow from the wellbore 18, through the annular space 32, and through one or more passageways 60, 66 extending axially across the annular sleeve 34 to the fluid processing system 38 positioned at a subsea location or at a surface location, in step 156. The casing 26 may be assembled and/or lowered into the wellbore 18 (e.g., the casing 26 may move in the axial direction 40 relative to the annular sleeve 34) as the fluid flows through the one or more passageways 60, 66 extending axially across the annular sleeve 34. Additionally or alternatively, the drill string 22 may move in the axial direction 40 and/or rotate relative to the annular sleeve 34 (e.g., to drill the wellbore 18) as the fluid flows through the one or more passageways 60, 66 extending axially across the annular sleeve 34. The disclosed method 150 may facilitate fluid flow out of the wellbore 18 and/or may facilitate pressure control within the wellbore 18 during various drilling and/or maintenance operations. The disclosed method 150 may also facilitate assembly and/or installation of the casing 26 on-site at a subsea location (e.g., using the casing assembly device 30), and in some embodiments, may facilitate assembly and/or installation of the casing 26 on-site at a subsea location as the wellbore 18 is drilled (e.g., via the drill string 22 and the tool 24).

Figure 7:
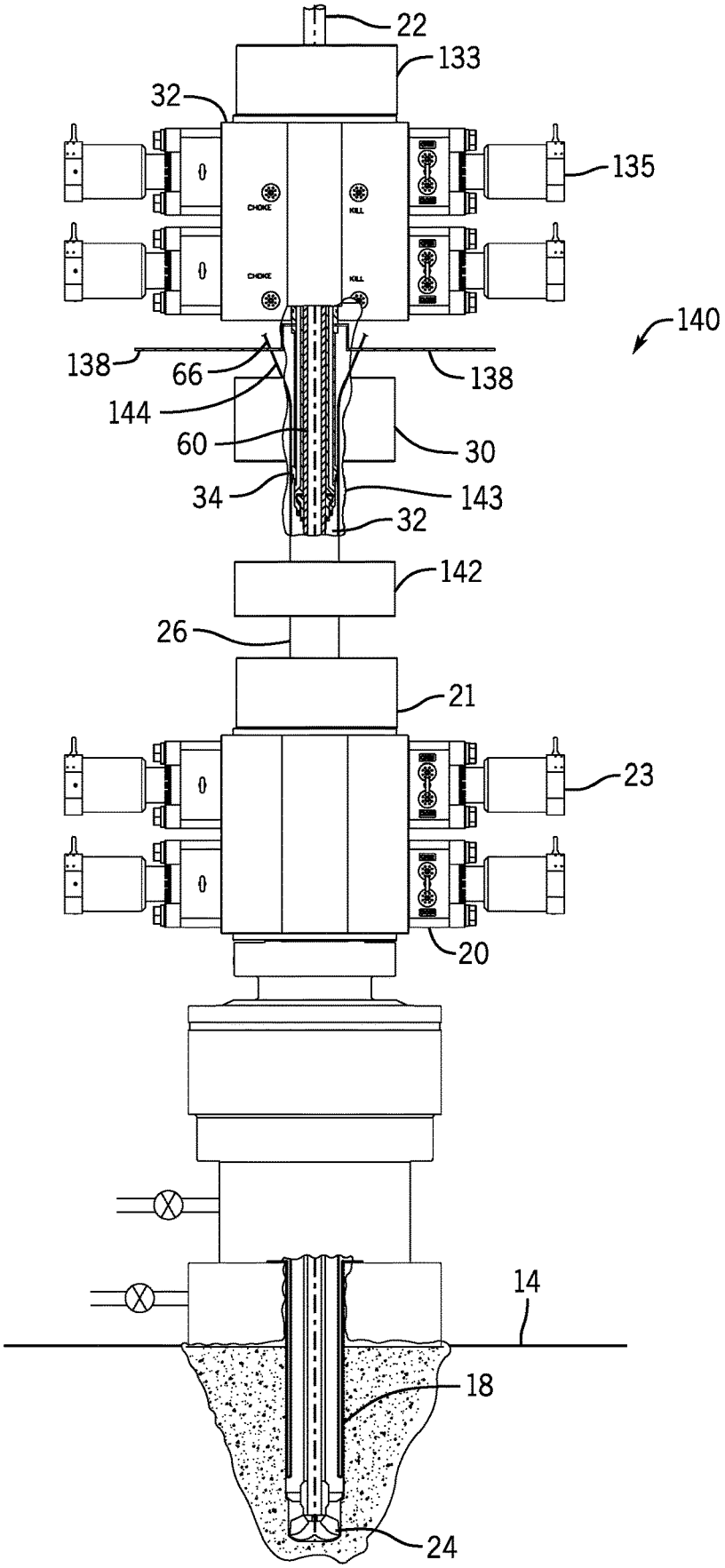
FIG. 7 is a side view of another offshore system that includes a casing feeder device and in which an annular sleeve is coupled to a stack assembly, in accordance with an embodiment of the present disclosure.

FIG. 7 is a side view of another offshore system 140 that includes a casing feeder device 142 and in which the annular sleeve 34 is coupled to the stack assembly 132, in accordance with an embodiment of the present disclosure. A portion of the offshore system 140 within line 143 is removed to provide a cross-sectional view of interior components of the annular sleeve 34. The stack assembly 132 may include at least one annular BOP 133 positioned axially above one or more ram BOPs 135 that are configured to selectively seal and/or block fluid flow through an annular space within the stack assembly 132. In the illustrated offshore system 140, the wellhead assembly 16 is positioned at the interface between the wellbore 18 and the sea floor 14, and the stack assembly 20 is positioned adjacent to the wellhead assembly 16. The drill string 22 extends from a location above the sea floor 14 into the wellbore 18. The tool 24 is positioned at one end of the drill string 22 to form the wellbore 18. In some embodiments, the offshore system 140 may be a riser-less system that does not include a riser that circumferentially surrounds the drill string 22 below the platform or drilling rig at the sea surface. As shown, the casing 26 is installed within the wellbore 18, and the annular sleeve 34 is positioned within the annular space 32 between the drill string 22 and the casing 26.

In the illustrated embodiment, the annular sleeve 34 is mechanically supported (e.g., suspended) by and coupled to the stack assembly 132 (e.g., via a key-slot interface). The passageways 60, 66 of the annular sleeve 34 may be fluidly coupled to the annular space within the stack assembly 132 and/or to one or more fluid conduits 138 within the stack assembly 132, such as a choke and kill line and/or a primary line, which are in turn coupled to a suitable fluid processing device, such as the fluid processing system 38, positioned at a subsea location or on a platform or drilling rig at the sea surface. Thus, in the illustrated offshore system 140, at least when the annular BOP 133 and/or the ram BOPs 135 seal the annular space of the stack assembly 132, fluid from the wellbore 18 may flow through the annular space 32, through the annular sleeve 34, and into the fluid conduits 138 extending from the stack assembly 132. The illustrated offshore system 140 may facilitate fluid flow out of the wellbore 18 and/or may facilitate pressure control within the wellbore 18 during various drilling and/or maintenance operations.

In the illustrated embodiment, the offshore system 140 includes the casing assembly device 30 to assemble the casing 26 on-site at the subsea location, and the stack assembly 132 is positioned axially above (e.g., relative to the wellbore 18) the casing assembly device 30. As shown, casing material 144 (e.g., sheets, wires, or other non-annular pieces of material; annular pieces of material) may be provided to the casing assembly device 30 to enable the casing assembly device 30 to assemble the casing 26 (e.g., annular casing). However, it should be appreciated that the casing material 144 may be stored within the casing assembly device 30 or provided to the casing assembly device 30 in any other suitable manner.

As shown, the offshore system 140 also includes a casing feeder device 142, which may operate to drive the casing 26 into the wellbore 18 after formation of the casing 26 at the casing assembly device 30. The casing feeder device 142 may be a separate device (e.g., in a separate housing), or the casing feeder device 142 may be incorporated into the casing assembly device 30 (e.g., the casing assembly device 30 may include components that operate to form the casing 26 and drive the casing 26 into the wellbore 18). As noted above, it should be understood that the disclosed annular sleeve 34 may be incorporated within any of a variety of offshore or onshore drilling and production systems. Thus, the offshore system 140 having the annular sleeve 34 may be configured for managed pressure drilling or conventional drilling operations that maintain hydrostatic pressure within the wellbore 18. Furthermore, the offshore system 140 having the annular sleeve 34 may be configured to utilize pre-formed casing sections (e.g., annular sections) and/or risers, and/or the annular sleeve 34 may be utilized within other annular spaces of the offshore system 140 to isolate and/or to direct fluid flow during drilling operations, maintenance operations, or the like, for example.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims. Furthermore, any of the features shown or described with reference to FIGS. 1-7 may be substituted for one another and/or combined in any of a variety of ways.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

an annular sleeve configured to be positioned in an annular space between a first annular component and a second annular component of a drilling system, wherein the annular sleeve comprises:

a radially-inner annular surface;

a radially-outer annular surface;

a first annular seal element coupled to the radially-inner annular surface and configured to seal against the first annular component;

a second annular seal element coupled to the radially-outer annular surface and configured to seal against the second annular component;

one or more axially-extending passageways extending from a first end to a second end of the annular sleeve; and a stab positioned at the first end of the annular sleeve to fluidly couple the one or more axially-extending passageways to a fluid processing system;

wherein the annular sleeve is configured to maintain the first annular seal element against the first annular component and to maintain the second annular seal element against the second annular component while at least one of the first annular component or the second annular component moves in an axial direction relative to the annular sleeve to thereby direct a fluid flow through the one or more axially-extending passageways across the annular sleeve.

2. The system of claim 1, wherein the annular sleeve is configured to be positioned in the annular space such that the first end of the annular sleeve extends above the second annular component along an axial axis and the second end of the annular sleeve is within the second annular component along the axial axis.

3. The system of claim 1, wherein the first annular component comprises a drill string.

4. The system of claim 3, wherein the second annular component comprises a casing.

5. The system of claim 3, wherein the drill string is configured to rotate to drill a wellbore, and the annular sleeve is configured to maintain the first annular seal element against the drill string and the second annular seal element against the second annular component while the drill string rotates relative to at least a body of the annular sleeve to direct the fluid flow through the one or more axially-extending passageways across the annular sleeve.

6. The system of claim 5, wherein the annular sleeve comprises a rotating seal carrier rotatably coupled to the body of the annular sleeve to enable the drill string to rotate relative to at least the body of the annular sleeve.

7. The system of claim 1, comprising an assembly device configured to assemble the second annular component about the first annular component as the fluid flow passes through the one or more axially-extending passageways of the annular sleeve.

8. The system of claim 7, wherein the annular sleeve extends through the assembly device such that the first end of the annular sleeve is positioned above the assembly device along an axial axis and the second end of the annular sleeve is positioned below the assembly device along the axial axis and within the second annular component.

9. The system of claim 8, comprising a blowout preventer stack assembly, wherein the first end of the annular sleeve is coupled to the blowout preventer stack assembly.

10. The system of claim 1, wherein the system comprises a riser-less drilling system.

11. A system, comprising:

a drill string configured to support a tool to drill a wellbore;

a casing configured to be inserted into the wellbore to support the wellbore;

a casing assembly device configured to assemble the casing about the drill string on-site at a subsea location; and an annular sleeve comprising one or more axially-extending passageways extending from a first end and a second end of the annular sleeve, wherein the second end of the annular sleeve is configured to be positioned within an annular space between the drill string and the casing, the first end of the annular sleeve is configured to be positioned axially above the casing, and the annular sleeve is configured to divert a flow of fluid from the wellbore into the one or more axially-extending passageways of the annular sleeve and to transfer the flow of fluid to a fluid processing system as the casing is assembled and inserted into the wellbore, and wherein at least one of the drill string or the casing is configured to move in an axial direction relative to the annular sleeve while the flow of fluid is diverted into the one or more axially-extending passageways.

12. The system of claim 11, wherein the casing assembly device is configured to assemble the casing as the tool drills the wellbore.

13. The system of claim 11, wherein the system comprises a riser-less drilling system.

14. The system of claim 11, wherein the tool is configured to rotate relative to the drill string to drill the wellbore.

15. The system of claim 11, comprising a blowout preventer stack assembly, wherein the first end of the annular sleeve is coupled to the blowout preventer stack assembly.

16. The system of claim 11, wherein the annular sleeve comprises a rotating seal carrier that enables the annular sleeve to divert the flow of fluid from the wellbore into the one or more axially-extending passageways of the annular sleeve and to transfer the flow of fluid to the fluid processing system as the drill string rotates with the tool to drill the wellbore.

17. The system of claim 11, wherein the system further comprises a stab positioned at the first end of the annular sleeve to fluidly couple the one or more axially-extending passageways to the fluid processing system.

18. A method, comprising:

assembling a tubular structure about a drill string as a tool at a distal end of the drill string drills a wellbore;

positioning an annular sleeve in an annular space between an assembled portion of the tubular structure and the drill string;

directing a fluid flow from the wellbore through one or more axially-extending passageways formed in the annular sleeve to a location axially above the assembled portion of the tubular structure; and rotating the drill string relative to at least a portion of the annular sleeve while directing the fluid flow through the one or more passageways.

19. The method of claim 18, comprising sealing a radially-inner annular wall of the annular sleeve against the drill string and sealing a radially-outer annular wall of the annular sleeve against the tubular structure.

20. The method of claim 18, comprising moving at least one of the drill string or the tubular structure in an axial direction relative to the annular sleeve while directing the fluid flow through the one or more passageways.

* * * * *